US007692387B2

(12) United States Patent
Park

(10) Patent No.: US 7,692,387 B2
(45) Date of Patent: Apr. 6, 2010

(54) PLASMA DISPLAY PANEL

(75) Inventor: Jung-Tae Park, Suwon-si (KR)

(73) Assignee: Samsung SDI Co. Ltd., Suwon-si, Gyeonggi-do (KR)

( * ) Notice: Subject to any disclaimer, the term of this patent is extended or adjusted under 35 U.S.C. 154(b) by 368 days.

(21) Appl. No.: 11/728,078

(22) Filed: Mar. 23, 2007

(65) Prior Publication Data

US 2007/0228945 A1 Oct. 4, 2007

(30) Foreign Application Priority Data

Mar. 28, 2006 (KR) ..... 10-2006-0028056
Mar. 28, 2006 (KR) ..... 10-2006-0028057

(51) Int. Cl.
*H01J 17/49* (2006.01)

(52) U.S. Cl. ..... 313/587; 313/583; 313/584; 313/585; 313/586

(58) Field of Classification Search ..... 313/582–587
See application file for complete search history.

(56) References Cited

U.S. PATENT DOCUMENTS

| | | | | |
|---|---|---|---|---|
| 5,852,347 | A * | 12/1998 | Marcotte | 315/169.4 |
| 6,411,035 | B1 * | 6/2002 | Marcotte | 313/585 |
| 2003/0076038 | A1 * | 4/2003 | Suzuki et al. | 313/582 |
| 2004/0212566 | A1 * | 10/2004 | Marcotte | 345/60 |
| 2005/0088377 | A1 * | 4/2005 | Marcotte | 345/60 |
| 2005/0285527 | A1 * | 12/2005 | Kwon et al. | 313/583 |

FOREIGN PATENT DOCUMENTS

| | | |
|---|---|---|
| KR | 10-2002-0064100 | 8/2002 |
| KR | 10-2006-0001537 | 1/2006 |

OTHER PUBLICATIONS

Korean Office Communication for Application No. 2009-05333087; dated Dec. 29, 2009, 4 pgs.

* cited by examiner

*Primary Examiner*—Bumsuk Won
(74) *Attorney, Agent, or Firm*—Knobbe Martens Olson & Bear LLP

(57) ABSTRACT

Provided is a plasma display panel that can increase bright room contrast and luminous efficiency. The plasma display panel includes a first substrate; a second substrate which is separated from the first substrate and faces the first substrate; a plurality of barrier ribs formed between the first and second substrates and defining a plurality of discharge cells; a plurality of sustain electrodes formed between the first and second substrates, comprising inner sustain electrodes and outer sustain electrodes; a plurality of scan electrodes formed in parallel to the sustain electrodes and comprising inner scan electrodes and outer scan electrodes; a plurality of address electrodes formed between the first and second substrates and extending in a direction crossing an extending direction of the sustain electrodes and the scan electrodes; an inner sustain connection electrode that electrically connects the inner sustain electrodes formed in adjacent discharge cells arranged in an extending direction of the address electrodes; and a discharge prevention element that prevents the generation of discharge in a non-discharge region around the inner sustain connection electrode, wherein the sustain electrodes and the scan electrodes are repeatedly and alternately disposed in each of the discharge cells, and adjacent electrodes of the outer sustain and outer scan electrodes formed in the two adjacent discharge cells arranged in an extending direction of the address electrodes are electrically connected to each other.

13 Claims, 9 Drawing Sheets

PLASMA DISPLAY PANEL

CROSS-REFERENCE TO RELATED PATENT APPLICATION

This application claims the benefit of Korean Patent Application Nos. 10-2006-0028056 and 10-2006-0028057, both filed on Mar. 28, 2006, in the Korean Intellectual Property Office, the disclosures of which are incorporated herein by reference.

BACKGROUND OF THE INVENTION

1. Field of the Invention

The present embodiments relate to a plasma display panel (PDP), and more particularly, to a PDP that can prevent neon discharge in non-discharge regions around a display region of the PDP that does not have transparent electrodes (ITOless).

2. Description of the Related Art

A PDP is a flat panel display device that displays images using plasma discharge of a gas in discharge cells constituting pixels. Recently, PDPs have received much attention as large flat panel display apparatuses since they can be manufactured to be thin, have a wide viewing angle, and can display high quality images.

A conventional alternating current (AC) three-electrode surface discharge type PDP includes a front panel and a rear panel. The front panel includes a front substrate, a plurality of sustain electrode pairs that are formed on the front substrate and generate sustain discharge, an upper dielectric layer that covers the sustain electrode pairs, and a passivation film coated on the upper dielectric layer. The rear panel includes a rear substrate, a plurality of address electrodes which are formed on the rear substrate and generate address discharge together with the sustain electrode pairs, a lower dielectric layer that covers the address electrodes, and a plurality of barrier ribs that define a plurality of discharge cells constituting pixels. A sealing layer is formed using frit glass on edges of the front panel and the rear panel. After aligning the front and rear panels, the sealing layer formed of frit glass is annealed to combine the front and rear panels by melting the sealing layer. Afterwards, air in each of the discharge cells and non-discharge regions is exhausted and a discharge gas is filled in the discharge cells. The discharge gas can be a gas mixture containing Ne gas mixed with Xe gas.

When a pulse voltage greater than a discharge breakdown voltage is alternately applied to the sustain electrode pairs of each of the discharge cells, plasma discharge is generated. Xe gas atoms are excited by colliding with electrons, and the Xe gas atoms generate ultraviolet rays when the excited Xe gas atoms are stabilized. The ultraviolet rays excite red, green, and blue color phosphor layers formed on the barrier ribs, and visible light is emitted from the phosphor layers and is transmitted through the front panel forming an image. However, the neon gas atoms emit orange visible light when the excited neon gas atoms are stabilized. The orange visible light reduces color purity and contrast of the image, thereby reducing display quality. In the prior art, to avoid the color purity and contrast reducing problem, a red color filter, a green color filter, and a blue color filter are formed corresponding to the red, green, and blue color discharge cells on a side of a panel through which the visible light passes, or dielectric color filters in which color filters respectively formed one unit in a dielectric layer are used to block the orange visible light emitted from the neon gas atoms. In this way, the affect of the neon discharge in the discharge cells is reduced.

Non-discharge regions defined by an outermost barrier rib and the frit glass sealing layer are located around a display region which consists of discharge cells, and the non-discharge regions are also filled with the discharge gas that contains neon gas. End terminals of the sustain electrode pairs that generate sustain discharge pass through the non-discharge regions located on left and right sides of the PDP. During a sustain discharge, a neon discharge can occur between the sustain electrodes and scan electrodes.

In particular, in the case of ITOless PDPs that do not use transparent electrodes to reduce material costs, at least two sustain electrodes and scan electrodes respectively are used instead of using one sustain electrode and scan electrode, to achieve stable discharge and to increase light emission efficiency. Also, to prevent crosstalk between adjacent discharge cells and to increase brightness, the sustain electrodes and the scan electrodes can be modified in various ways including the numbers thereof, location arrangement, and methods of driving. In this case, neon discharge is more likely to occur in the non-discharge regions.

When neon discharge occurs in the non-discharge regions located around the discharge region, orange visible light generated from the neon discharge is transmitted through the front panel, thereby reducing display quality of images of the PDP.

SUMMARY OF THE INVENTION

The present embodiments provide a plasma display panel (PDP) that can increase bright room contrast and luminous efficiency.

According to an aspect of the present embodiments, there is provided a plasma display panel comprising: a first substrate; a second substrate which is separated from the first substrate and faces the first substrate; a plurality of barrier ribs formed between the first and second substrates and defining a plurality of discharge cells; a plurality of sustain electrodes formed between the first and second substrates, comprising inner sustain electrodes and outer sustain electrodes; a plurality of scan electrodes formed in parallel to the sustain electrodes and comprising inner scan electrodes and outer scan electrodes; a plurality of address electrodes formed between the first and second substrates and extending in a direction crossing an extending direction of the sustain electrodes and the scan electrodes; an inner sustain connection electrode that electrically connects the inner sustain electrodes formed in adjacent discharge cells arranged in an extending direction of the address electrodes; and a discharge prevention element that prevents the generation of discharge in a non-discharge region around the inner sustain connection electrode, wherein the sustain electrodes and the scan electrodes are repeatedly and alternately disposed in each of the discharge cells, and adjacent electrodes of the outer sustain and outer scan electrodes formed in the two adjacent discharge cells arranged in an extending direction of the address electrodes are electrically connected to each other.

The discharge prevention element may be a dummy barrier rib formed on the second substrate.

Some embodiments relate to a display panel wherein each of a plurality of voltages applied to the inner sustain electrodes and the outer sustain electrodes is independently controlled, and each of a plurality of voltages applied to the inner scan electrodes and the outer scan electrodes is independently controlled.

BRIEF DESCRIPTION OF THE DRAWINGS

The above and other features and advantages of the present embodiments will become more apparent by describing in detail exemplary embodiments thereof with reference to the attached drawings in which.

DETAILED DESCRIPTION OF THE INVENTION

Figure 1:
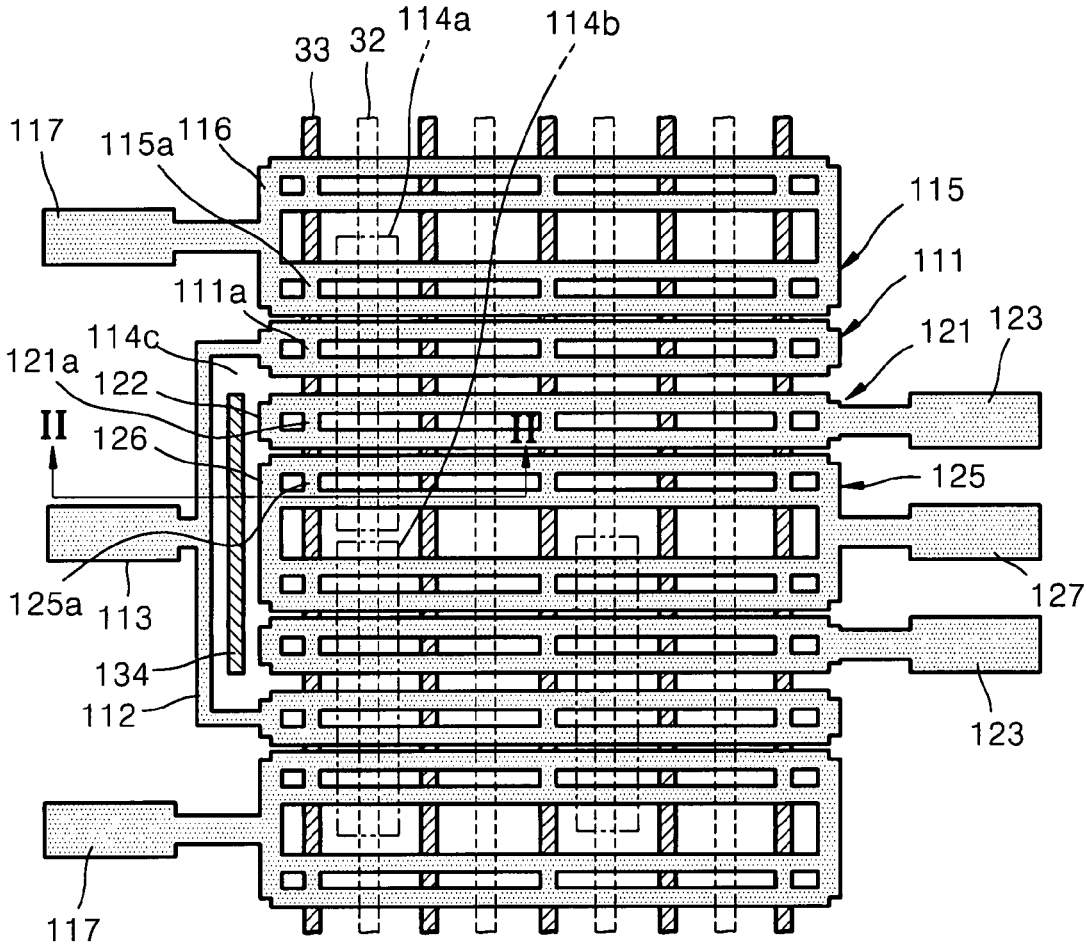
FIG. 1 is a plan view illustrating a plasma display panel (PDP) according to an embodiment.

The present embodiments will now be described more fully with reference to the accompanying drawings in which exemplary embodiments are shown. FIG. 1 is a plan view illustrating a plasma display panel (PDP) according to an embodiment, and FIG. 2 is a cross-sectional view taken along a line II-II of FIG. 1.

Figure 2:
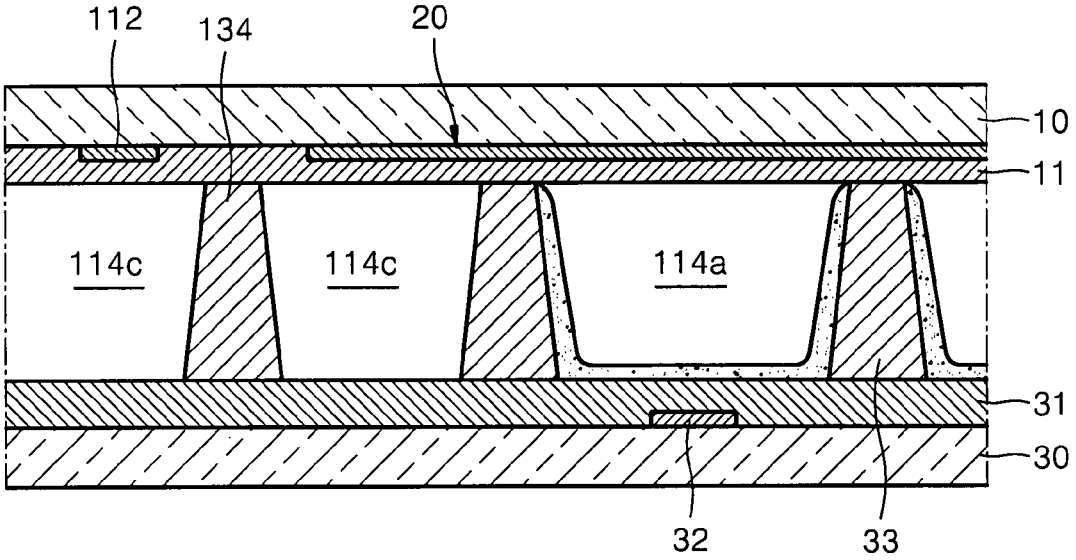
FIG. 2 is a cross-sectional view taken along a line II-II of FIG. 1, according to an embodiment.

Referring to FIGS. 1 and 2, the PDP according to the embodiment includes a front panel and a rear panel. The front panel includes a front substrate 10 and the rear panel includes a rear substrate 30. The rear panel includes a reflective layer (not shown) for reflecting visible light, and the front substrate 10 is formed of a transparent material such as glass so that visible light can be transmitted through the front substrate 10. Accordingly, visible light generated from phosphor layers, which will be described later, is not transmitted through the rear panel but is transmitted through the front panel. However, the present embodiments are not limited thereto, and can also be applied to a transmission type PDP through which visible light is transmitted without reflection. A sustain electrode pair 20 that generates sustain discharge is formed on the front substrate 10.

Sustain electrode pairs 20 that include sustain electrodes and scan electrodes are disposed parallel to each other in a discharge space of each of discharge cells 114*a* and 114*b*. The sustain electrodes include a plurality of outer sustain electrodes 115 and a plurality of inner sustain electrodes 111, and the scan electrodes include a plurality of inner scan electrodes 121 and a plurality of outer scan electrodes 125. The inner sustain electrodes 111 and the inner scan electrodes 121 are formed in parallel to each other with respect to the center of the discharge space of each of the discharge cells 114*a* and 114*b*, and the outer sustain electrode 115 and the outer scan electrodes 125 are respectively formed on outside the inner sustain electrodes 111 and the inner scan electrodes 121.

The sustain electrodes and the scan electrodes are repeatedly and alternately disposed in the discharge cells 114*a* and 114*b*. That is, the sustain electrodes and the scan electrodes are arranged in an order such that the outer sustain electrodes 115, the inner sustain electrodes 111, the inner scan electrodes 121, and the outer scan electrodes 125 are formed in parallel to each other parallel to each other in each discharge cell 114*a*. In the discharge cell 114*b* adjacent to the discharge cell 114*a* in a vertical direction (in an extending direction of address electrodes 32), the outer scan electrodes 125, the inner scan electrodes 121, the inner sustain electrodes 111, and the outer sustain electrodes 115 are sequentially disposed parallel to each other. In another discharge cell below the discharge cell 114*b* (adjacent to the discharge cell 114*b* in the extending direction of the address electrodes 32), the sustain electrodes and the scan electrodes are formed in parallel to each other.

The inner sustain electrodes 111 of the two adjacent discharge cells 114*a* and 114*b* extending in the direction in which the barrier ribs 33 extend (in the extending direction of the address electrodes 32), are electrically connected to each other by an inner sustain connection electrode 112. An inner sustain terminal electrode 113 is connected to the inner sustain connection electrode 112, and although not shown, the inner sustain terminal electrode 113 is electrically connected to a signal transmission element (not shown) such as a tape carrier package or a chip on film that transmits electrical signals for driving the inner and outer sustain electrodes 111 and 115.

The outer sustain electrodes 115 of the two adjacent discharge cells 114*a* and 114*b* extending in the direction in which the barrier ribs 33 extend, are electrically connected to each other by an outer sustain connection electrode 116. The inner sustain terminal electrode 113 is connected to the outer sustain connection electrode 116, and is electrically connected to a signal transmission element (not shown). The outer scan electrodes 125 of the two adjacent discharge cells 114*a* and 114*b* extending in a direction in which the barrier ribs 33 extend are electrically connected to each other by an outer scan connection electrode 126. An outer scan terminal electrode 127 is connected to the outer scan connection electrode 126, and is also electrically connected to a signal transmission element (not shown) that transmits electrical signals for driving the inner and outer scan electrodes 121 and 125.

The outer sustain electrodes 115, the inner sustain electrodes 111, the outer scan electrodes 125, and the inner scan electrode 121 respectively, are closed loop type electrodes, and formed of an opaque metal that contains, for example, Cr—Cu—Cr, Ag or another material having high electrical conductivity. An upper electrode and a lower electrode of each of the outer sustain electrodes 115, the inner sustain electrodes 111, the outer scan electrodes 125, and the inner scan electrodes 121 are connected by short bars 115*a*, 111*a*, 125*a*, and 121*a*, respectively. That is, the upper and lower electrodes of the outer sustain electrodes 115 are electrically connected by the short bar 115*a*, and the upper and lower electrodes of the inner sustain electrodes 111 are electrically connected by the short bar 111*a*. Also, the upper and lower electrodes of the outer scan electrodes 125 are electrically connected by the short bar 125*a*, and the upper and lower electrodes of the inner scan electrodes 121 are electrically connected by the short bar 121*a*. The short bars 115*a*, 111*a*, 125*a*, and 121*a* are formed in a direction substantially perpendicular to the extending direction of the outer sustain electrodes 115, the inner sustain electrodes 111, the outer scan electrodes 125, and the inner scan electrodes 121, and may be formed at locations corresponding to the barrier ribs 33 to prevent visible light from being blocked by the outer sustain electrodes 115, the inner sustain electrodes 111, the outer scan electrodes 125, and the inner scan electrodes 121. However, the scope of the present embodiments are not limited thereto, that is, short bars can be formed on locations corresponding to discharge spaces and not to the barrier ribs 33. The short bars 115*a*, 111*a*, 125*a*, and 121*a* ensure the flow of current in the loops of the outer sustain electrodes 115, the inner sustain electrodes 111, the outer scan electrodes 125, and the inner scan electrode 121 even though there is a loss of connection in each of the loops of the outer sustain electrodes 115, the inner sustain electrodes 111, the outer scan electrodes 125, and the inner scan electrode 121.

A front dielectric layer 11 is formed on the front substrate 10 to protect the sustain electrodes and scan electrodes by covering the sustain electrodes and scan electrodes. A passivation film 12 is formed on a surface of the front dielectric layer 11 to protect the front dielectric layer 11 and to facilitate discharge by increasing the emission of secondary electrons during discharge. The passivation film 12 can be formed of MgO, for example.

The rear substrate 30 includes address electrodes 32 formed in a direction substantially perpendicular to the direction in which the sustain electrodes and scan electrodes extend. A rear dielectric layer 31 is further formed on the rear substrate 30 to protect the address electrodes 32 by covering the address electrodes 32. The barrier ribs 33, are stripe-shaped in the shown embodiment, however the present embodiments are not limited thereto. The barrier ribs 33 are formed on the rear substrate 30 to define the plurality of discharge cells 114*a* and 114*b* in which discharge for generating visible light for displaying images occurs. The barrier ribs 33 prevent crosstalk between the discharge cells 114*a*. The barrier ribs 33 according to the present embodiments are not limited to the stripe shape, and can have various polygonal horizontal cross-sections such as rectangular, hexagonal, or octagonal cross-sections; or can have circular or oval cross-sections. Red, green, and blue phosphor layers 13 are formed in the discharge cells 114*a* defined by the barrier ribs 33.

The front panel and the rear panel may be combined by a combining member such as a sealing frit (not shown). A discharge gas including Xe gas and at least one of Ne gas, He gas, and Ar gas is filled in the discharge cells 114*a*.

Non-discharge cells 114*c* are present in non-discharge regions on outer left and right sides of each of the discharge cells 114*a* in which visible light for displaying images is generated. The non-discharge cells 114*c* can be defined by the barrier ribs 33 and the sealing frit, or by the barrier ribs 33 and other barrier ribs (not shown). The discharge gas is also filled in the non-discharge cell 114*c*. The inner sustain connection electrode 112, the outer scan connection electrode 126, and the inner scan connection electrode 122 are disposed in the non-discharge cell 114*c* located on a left sided non-discharge region.

A portion of the inner sustain connection electrode 112 that generates sustain discharge and portions of the inner scan connection electrode 122 and the outer scan connection electrode 126 are disposed to face each other in the non-discharge region of the non-discharge cells 114*c*. The inner sustain connection electrode 112 and the inner and outer scan connection electrodes 122 and 126 that face the inner sustain connection electrode 112 can cause unwanted neon discharge during address discharge and sustain discharge. Neon discharge will be described in brief as follows. A plasma discharge occurs by excitation energy emitted from Xe atoms while the Xe atoms are stabilized, and is accelerated through a penning effect. Penning is a reaction that accelerates an ionization reaction of an element through the formation of another element in a metastable state. Here, the metastable state atoms are neon gas atoms, and the neon discharge firstly occurs since the neon atoms emit energy ahead of the Xe atoms.

Accordingly, in order to prevent the occurrence of neon discharge, a dummy barrier rib 134 is formed on the rear substrate 30. The dummy barrier rib 134 is formed on a location between the inner sustain connection electrode 112 and the inner and outer scan connection electrodes 122 and 126. That is, the occurrence of the neon discharge in the non-discharge region can be prevented by blocking the discharge space between the inner sustain connection electrode 112 and the inner and outer scan connection electrodes 122 and 126.

The dummy barrier rib 134 can be simultaneously formed when the barrier ribs 33 that define the discharge cells 114*a* are formed or can be formed after the discharge cells 114*a* are formed. The barrier ribs 33 can be formed using various methods such as screen printing, sand blast, lift-off, photolithography, or etching.

Figure 3:
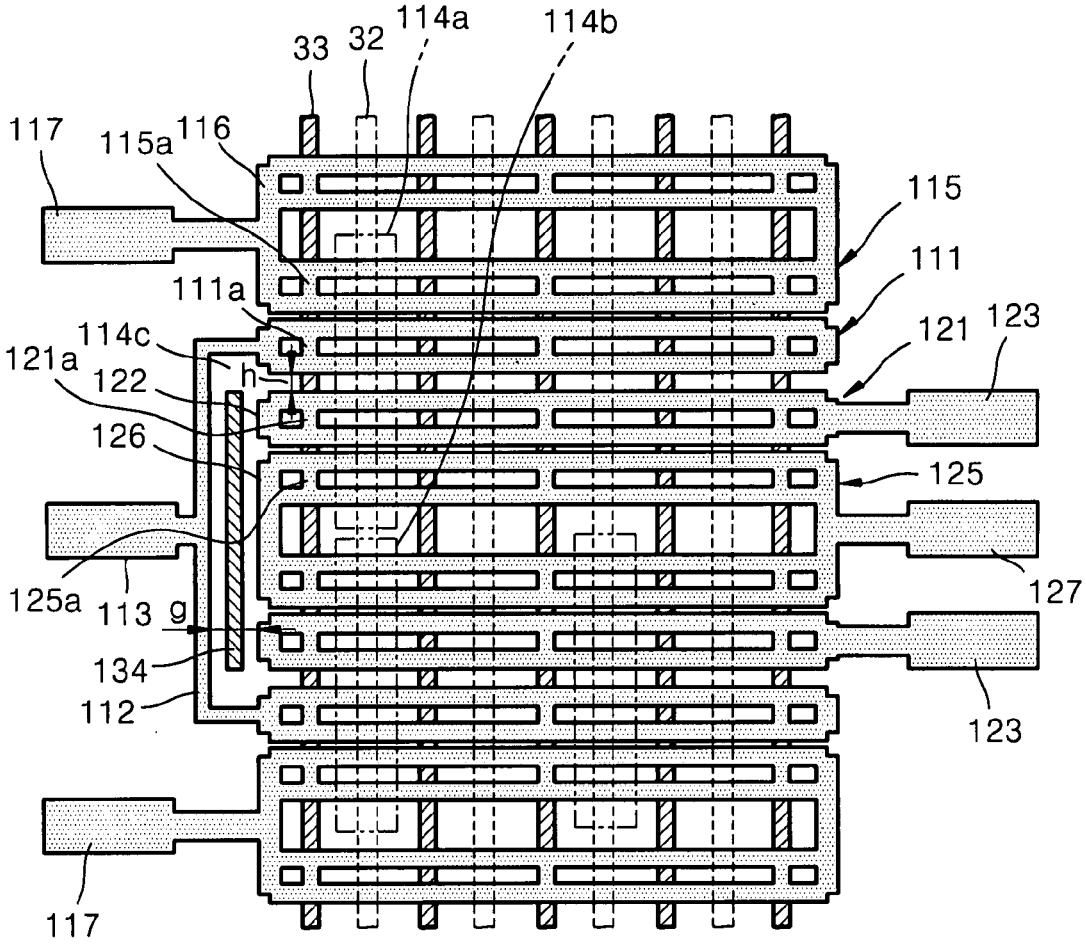
FIG. 3 is a plan view illustrating a modified version of the PDP of FIG. 1, according to an embodiment.

FIG. 3 is a plan view illustrating a modified version of the PDP of FIG. 1. In order to prevent the occurrence of neon discharge, as depicted in FIG. 3, additionally, a distance g between the inner sustain connection electrode 112 and the outer scan connection electrode 126, and between the inner sustain connection electrode 112 and the inner scan connection electrode 122 can be formed greater than a distance h between the inner sustain electrode 111 and the inner scan electrode 121.

The separated distance g between the inner sustain connection electrode 112 and the outer scan connection electrode 126, and between the inner sustain connection electrode 112 and the inner scan connection electrode 122 can be more than twice the distance h between the inner sustain electrode 111 and the inner scan electrode 121. The distance g may vary according to the composition of the discharge gas or the magnitude of the voltage applied. Therefore, it is understood by those of ordinary skill in the art that various changes in form and details may be made without departing from the spirit and scope of the present embodiments.

Although not shown, neon discharge can be prevented by forming the distance g between the inner sustain connection electrode 112 and the outer scan connection electrode 126, and between the inner sustain connection electrode 112 and the inner scan connection electrode 122 to be greater than the distance h between the inner sustain electrode 111 and the inner scan electrode 121. In this case, the distance g between the inner sustain connection electrode 112 and the outer scan connection electrode 126, and between the inner sustain connection electrode 112 and the inner scan connection electrode 122 can be twice or greater than the distance h between the inner sustain electrode 111 and the inner scan electrode 121.

Figure 4:
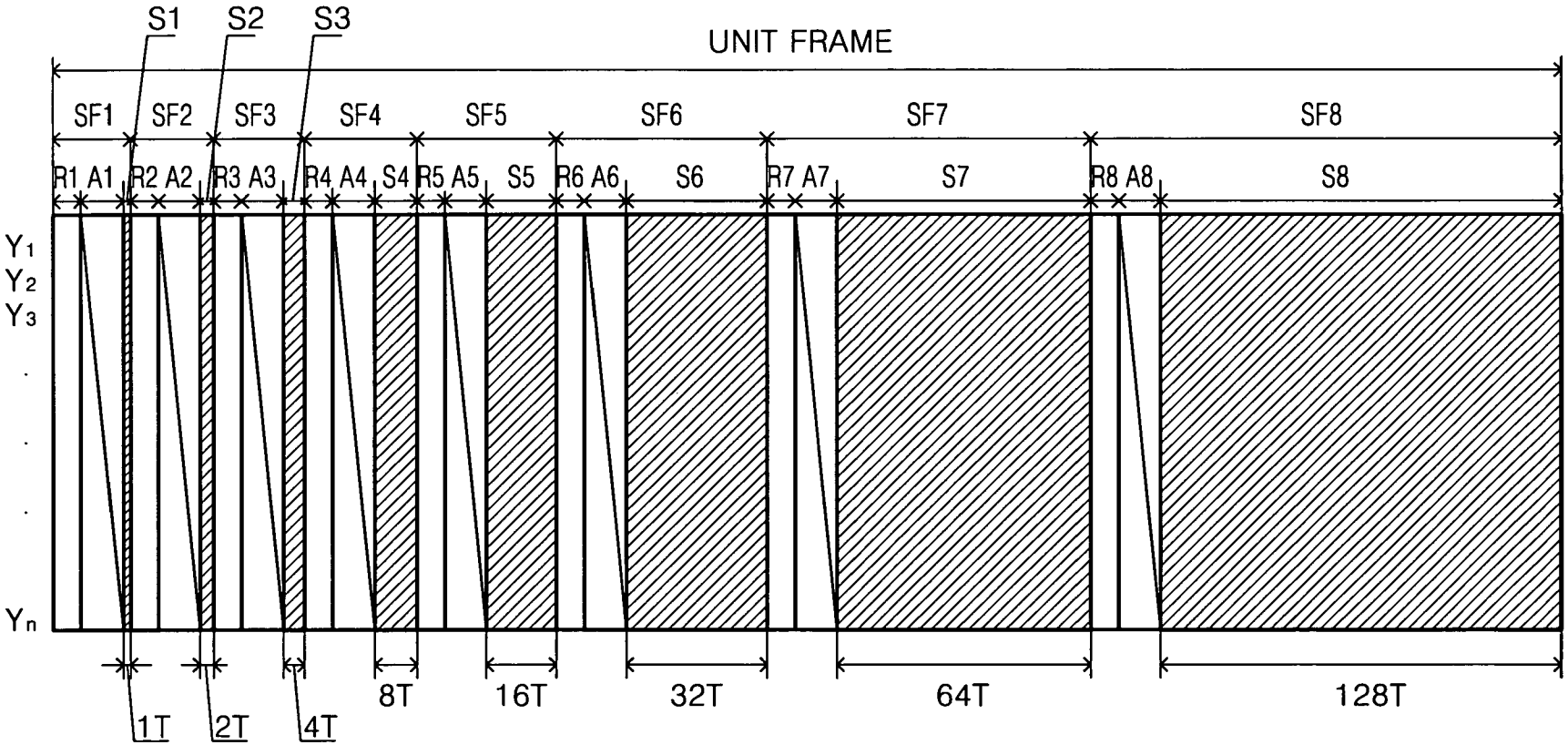
FIG. 4 is a diagram for explaining a method of driving a PDP according to an embodiment.

An operation and function of a PDP according to an embodiment will now be described. FIG. 4 is a diagram for explaining a method of driving a PDP according to an embodiment. An address display separation (ADS) driving method, which is an example of a method of driving a PDP, will be described with reference to FIG. 4.

In order to display an image on a PDP in response to external image signals, each of sixty unit image frames must be able to display 256 grey scales per second. Each of the image frames must be completely timely separated. That is, a motion image for one second can be displayed by the sixty unit image frames, which are independently displayed. To display an image, one unit image frame time is divided into eight subfield SF times, that is, from a first subfield SF1 to an eighth subfield SF8, and each subfield SF consists of a series of reset discharges R1, R2, . . . R8, address discharges A1, A2, . . . A8, and sustain discharges S1, S2, . . . S8. Sixty unit image frames having the above configuration consecutively display images for one second to display a motion image, thereby displaying an image using the ADS driving method.

However, the PDP illustrated in FIGS. 1 and 2 employs a light emitting structure in which wall charges are accumulated in the discharge cells 114*a*, and visible light is emitted due to sustain discharge generated with the aid of the wall charges. In general, to display an image, discharge is generated in the discharge cells 114*a* and 114*b* included in the PDP. Due to the discharge, the state of the wall charges or the amount of charged particles differ between the discharge cells 114*a* and 114*b*, and accordingly, the discharge generated in the discharge cells 114*a* and 114*b* cannot be uniformly controlled.

To uniformly control the discharge, a discharge is simultaneously generated in the entire discharge cells 114*a* and 114*b* by applying a voltage higher than a predetermined level. In this way, uniform states of wall charges and charged particles in the discharge cells 114*a* and 114*b* can be achieved. This discharge is called reset discharge.

After the reset discharge is generated, address discharge is generated. The address discharge generally denotes that, to select discharge cells 114*a* and 114*b* in which an image is displayed by generating visible light from the discharge cells 114*a* and 114*b* that are selected by the inner scan electrodes 121, the outer scan electrodes 125 and the address electrodes 32 crossing each other, discharge is generated by applying a pulse voltage to the inner scan electrodes 121, the outer scan electrodes 125 and the address electrodes 32, and, as a result, wall charges are generated on inner walls of the discharge cells 114*a* due to the accumulation of charged particles generated during the discharge. In this way, as described above, the address discharge is used to select the discharge cells 114*a* and 114*b* by accumulating wall charges on the inner walls of the discharge cells 114*a*, and to cause sustain discharge, which will be described later, with the aid of the wall charges.

After the address discharge, sustain discharge is generated to display an image. The sustain discharge is generated to emit a predetermined amount of visible light from the discharge cells 114*a* and 114*b* selected by the address discharge by predetermined times alternately forming potential differences between the sustain electrodes and scan electrodes. The sustain discharge is substantially an operation for displaying an image.

Since wall charges are accumulated in the discharge cells 114*a* where the address discharge is generated, when a voltage lower than the discharge breakdown voltage is alternately applied to the plurality of electrode pairs 111 and 121 disposed in all of the discharge cells 114*a* and 114*b*, a potential formed by adding a potential formed by the wall charges and a potential formed between the sustain electrodes and scan electrodes exceeds the discharge breakdown voltage. Thus, the sustain discharge is generated only in the discharge cells 114*a* in which the address discharge is generated, and visible light is emitted from the discharge cells 114*a* and 114*b* in which the address discharge is generated.

Each of the unit image frames consists of eight sequential subfields, and the unit image frame can display a predetermined grey scale by controlling the generation of sustain discharge in each subfield. The sixty unit image frames each having a predetermined grey scale display an image for one second in one of the pixels. The images displaying for one second in each of the pixels constitute an entire image.

Figure 5:
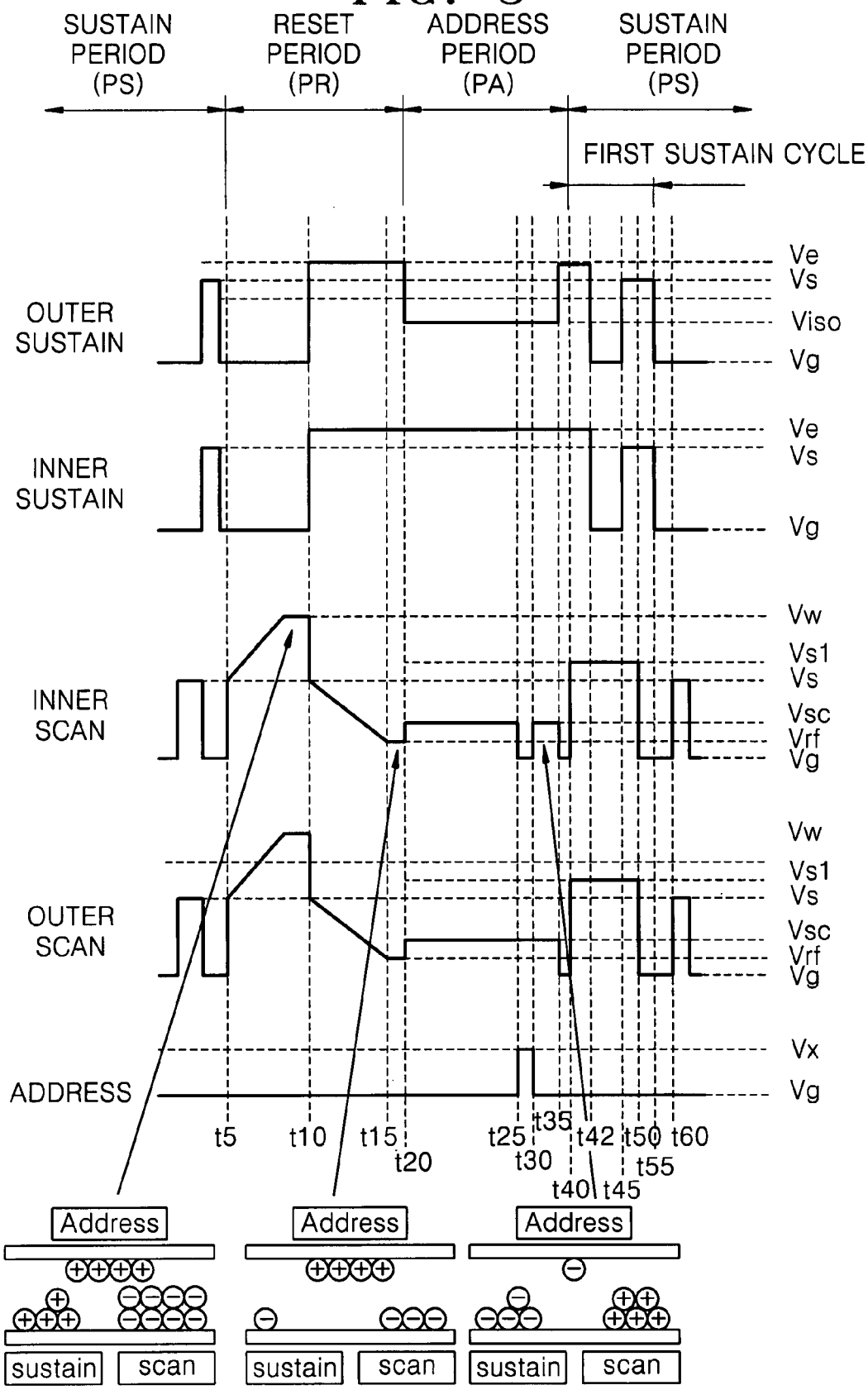
FIG. 5 is a first example timing diagram for explaining a driving signal of a PDP according to an embodiment.

FIG. 5 is a first example timing diagram for explaining a driving signal of the PDP illustrated in FIGS. 1 and 2, according to an embodiment. Referring to FIG. 5, a unit image frame for driving the PDP is divided into a plurality of subfields, each of the subfields consisting of a reset period PR, an address period PA, and a sustain period PS.

In the reset period PR, a reset discharge is generated by applying a reset pulse composed of a rising pulse and a falling pulse to the inner and outer scan electrodes 121 and 125, and by applying a voltage Ve to the sustain electrodes 111 and 115 from the point when the falling pulse of the reset pulse is applied to the inner and outer scan electrodes 121 and 125. The rising pulse applied to the inner and outer scan electrodes 121 and 125 gradually increases from a voltage Vs and reaches a maximum voltage Vw. Due to applying a rising lamp signal having a gentle slope to the inner and outer scan electrodes 121 and 125, weak discharge is generated and negative charges begin to accumulate near the inner scan electrode 121 (t5 to t10). The falling pulse applied to the inner and outer scan electrodes 121 and 125 gradually reduces from the voltage Vs, and finally reaches a voltage Vrf. A portion of the negative charges accumulated on the inner scan electrode 121 is released while discharge is generated (t20).

As a result of the reset discharge, all of the discharge cells 114*a* are initialized with an identical state by accumulating negative charges on the inner scan electrode 121 and positive charges on the address electrode 32 in each of the discharge cells 114*a*. Thus, the discharge cells 114*a* are in a state that can readily generate next address discharge. In the reset period PR t5 to t 20, a voltage having an identical waveform is applied to the inner scan electrode 121 and the outer scan electrode 125.

In the address period PA, address discharge is generated by sequentially applying a scan pulse Vg to the inner scan electrodes 121 in each row and a display data signal voltage Vx to the address electrodes 32 in each column in step with the scan pulse Vg. That is, the address discharge is sequentially performed row by row in such a manner that the display data signal voltage Vx is applied to the address electrodes 32 corresponding to the discharge cells 114*a* to be lighted in a row, and the display data signal voltage Vx is applied to the address electrodes 32 corresponding to the discharge cells 114*a* to be lighted in the next row. Due to the address discharge, discharge cells 114*a* in which sustain discharge is generated in the sustain period PS are selected. During the address period PA, a ground voltage Vg is applied to the inner scan electrode 121, and a positive scan voltage Vsc is applied to the address electrode 32. Also, in the address period PA, a positive voltage Ve is continuously applied to the inner sustain electrode 111. Address discharge is generated by a wall voltage caused by negative charges near the scan electrodes 121 and a wall voltage caused by positive charges near the address electrodes 32 together with the display data signal voltage Vx. As a result, positive charges are accumulated on the inner scan electrode 121 and negative charges are accumulated on the sustain electrode 111 (t30).

Since a voltage higher than a voltage applied to the inner scan electrode 121 is applied to the outer scan electrode 125, the address discharge does not progress toward the outer scan electrode 125. Similarly, since a voltage higher than a voltage applied to the outer sustain electrode 115 is applied to the inner sustain electrode 111, the address discharge does not progress toward the outer sustain electrode 115. An address discharge current is greatly reduced since the address discharge is limited in a region between the address electrodes 32 and the inner scan electrode 121 and the inner sustain electrode 111. Here, waveforms of the voltages applied to the outer scan electrode 125 and the inner scan electrode 121 are different from each other in the period when the address discharge is generated (t25 to t30), and waveforms of the voltages applied to the inner sustain electrode 111 and the outer sustain electrode 115 are different from each other during the address period (t20 to t40).

During the address discharge, neon discharge can occur between the inner sustain connection electrode 112 formed in the non-discharge region of the non-discharge cells 114*c* located on a left side of the display region and the inner scan electrode 121 and the outer scan connection electrode 126. This is because the neon discharge has a lower breakdown voltage than that of the Xe discharge. However, a dummy barrier rib 134 according to an embodiment formed between the inner sustain connection electrode 112 and the inner scan electrode 121 and the outer scan connection electrode 126 prevents the generation of neon discharge. Also, neon discharge can be prevented since the distance g between the inner sustain connection electrode 112 and the outer scan connection electrode 126 and between the inner sustain connection electrode 112 and the inner scan connection electrode 122 is greater than the distance h between the inner sustain electrode 111 and the inner scan electrode 121.

Accordingly, image quality of the PDP illustrated in FIGS. 1 and 2 according to an embodiment can be increased by preventing the generation of orange visible light in the non-display regions around the display region.

In the sustain period PS after the address period PA, a sustain pulse is alternately applied to the inner and outer sustain electrodes 111 and 115 and the inner and outer scan electrodes 121 and 125. Sustain discharge is generated due to collision between the discharge gas and positive charges accumulated near the inner scan electrode 121 migrating to the inner sustain electrode 111 by applying a straight voltage Vs1 to the inner scan electrode 121, and negative charges accumulated near the inner sustain electrode 111 migrating to the inner scan electrode 121 by applying a ground voltage Vg. Next, another sustain discharge is generated by diffusing again the negative charges accumulated on the inner scan electrode 121 to the inner sustain electrode 111 by applying the ground voltage Vg to the inner scan electrode 121, and migrating the positive charges accumulated on the inner sustain electrode 111 to the inner scan electrode 121 by applying the straight voltage Vs to the inner sustain electrode 111.

The sustain discharge is performed in the discharge cells 114*a* selected by the address discharge as described above. The control of brightness in the unit image frame consisting of the plurality of subfields is performed according to the number of times of sustain discharge based on a weighted grey scale allocated to each of the subfields. As a result, a grey scale brightness is displayed in each unit image frame.

The sustain pulse alternately has the straight voltage Vs and the ground voltage Vg. Waveforms applied to the inner sustain electrode 111 and the outer sustain electrode 115 during the sustain period PS is identical. Accordingly, the sustain discharge initiated between the inner sustain electrode 111 and the inner scan electrode 121 is diffused towards the outer sustain electrode 115 and the outer scan electrode 125. As a result, the region of the sustain discharge increases, thereby increasing luminous efficiency.

During the sustain discharge, neon discharge can be generated between the inner sustain connection electrode 112 formed in the non-discharge region of the non-discharge discharge cells 114*c* located on a left side of the display region and the inner scan electrode 121 and the outer scan connection electrode 126. This is because gaps between the inner sustain connection electrode 112 and the inner scan electrode 121 and between the inner sustain connection electrode 112 and the outer scan connection electrode 126 are not large, and because the neon discharge has a lower discharge breakdown voltage than the Xe discharge. However, in the present embodiment, the dummy barrier rib 134 formed between the inner sustain connection electrode 112 and the inner scan electrode 121 and the outer scan connection electrode 126 prevents the generation of neon discharge. Also, neon discharge is prevented since the distance g between the inner sustain connection electrode 112 and the outer scan connection electrode 126, and between the inner sustain connection electrode 112 and the inner scan connection electrode 122 is greater than the distance h between the inner sustain electrode 111 and the inner scan electrode 121. Therefore, image quality of the PDP illustrated in FIGS. 1 and 2 according to an embodiment can be increased by preventing the generation of orange visible light in the non-display discharge cells 114*c* around the display region.

Figure 6:
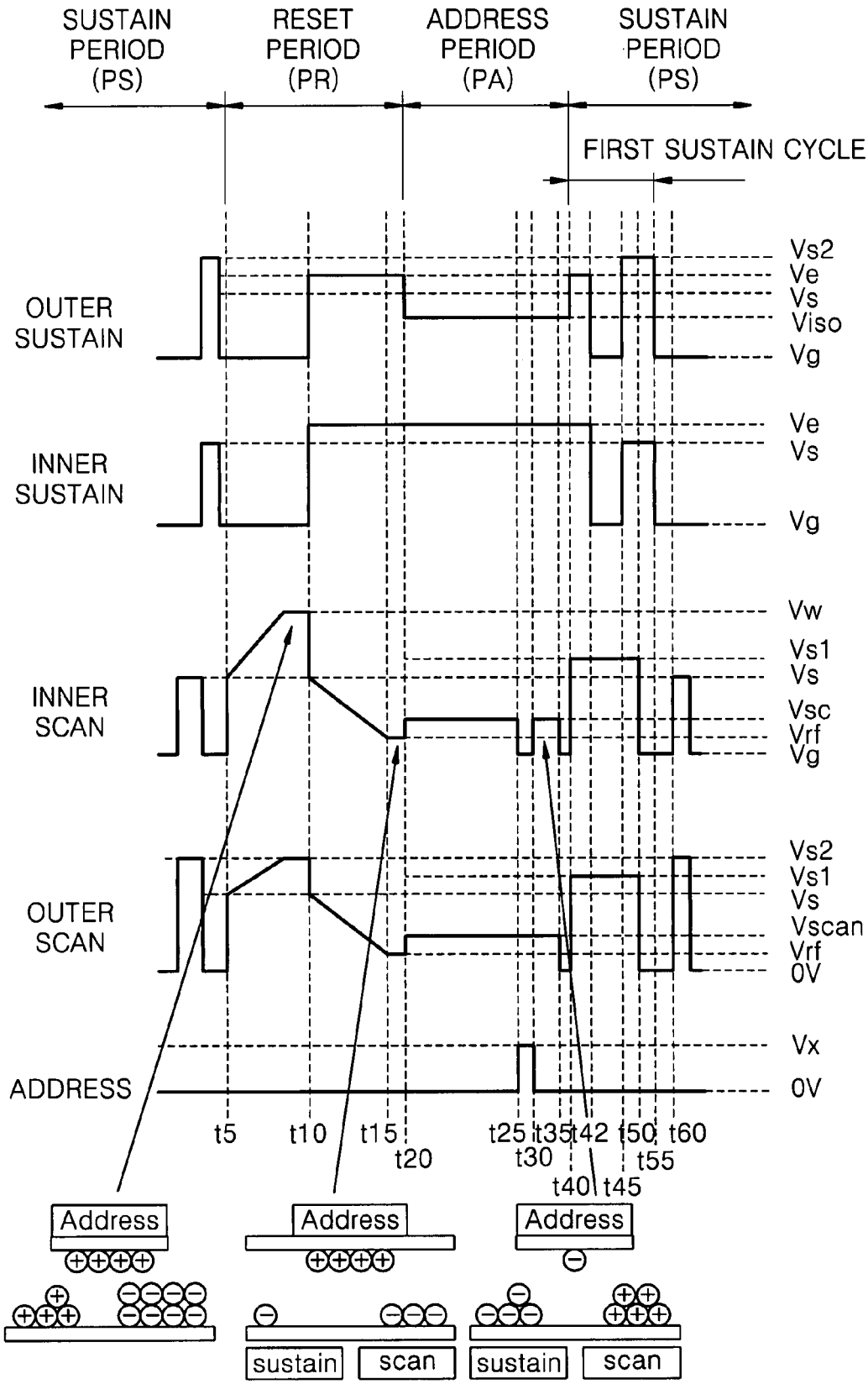
FIG. 6 is a second example timing diagram for explaining a driving signal of a PDP according to an embodiment.

FIG. 6 is a second example timing diagram for explaining a driving signal of the PDP illustrated in FIGS. 1 and 2, according to an embodiment. Referring to FIG. 6, during a reset period PR and a address period PA, the driving signal has the same waveforms as the waveforms of FIG. 5. Accordingly, the functions and operations of the PDP in the reset period PR and the address period PA are identical to those described with reference to FIG. 5.

During a sustain period PS, a sustain voltage Vs2 applied to the outer sustain electrode 115 is higher than a sustain voltage Vs applied to the inner sustain electrode 111, and the sustain voltage Vs2 applied to the outer scan electrode 125 is higher than the sustain voltage Vs applied to the inner scan electrode 121. Accordingly, a sustain discharge generated between the inner sustain electrode 111 and the inner scan electrode 121 is readily diffused towards the outer sustain electrode 115 and the outer scan electrode 125. That is, a gap between the inner and outer scan electrodes 121 and 125 can be increased as the larger the voltage differences between the outer sustain electrode 115 and the inner sustain electrode 111 and between the outer scan electrode 125 and the inner scan electrode 121. As a result, the discharge region increases, thereby increasing luminous efficiency of the PDP.

Figure 7:
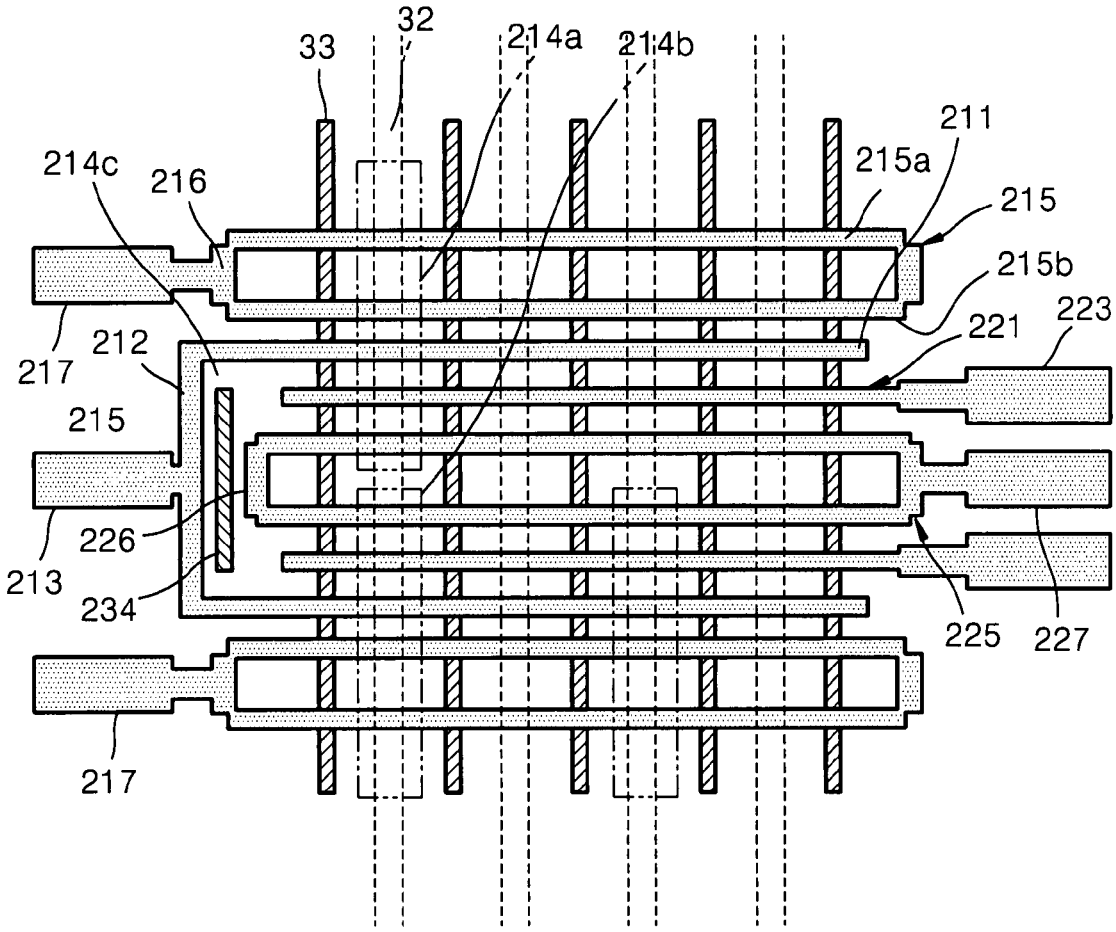
FIG. 7 is a plan view illustrating a plasma display panel according to another embodiment.

FIG. 7 is a plan view illustrating a PDP according to another embodiment. In explaining the present embodiment, differences between FIGS. 1 through 3 and FIG. 7 will be described.

Sustain electrodes and scan electrodes are disposed parallel to each other in a discharge space of each of a plurality of discharge cells 214*a*. Each of the sustain electrodes includes an outer sustain electrode 215 and an inner sustain electrode 211, and each of the scan electrodes includes an inner scan electrode 221 and an outer scan electrode 225. That is, the inner sustain electrode 211 and the inner scan electrode 221 are formed parallel to each other on both sides of the center of a discharge space of each of discharge cells 214*a* 214*b*, and the outer sustain electrode 215 and the outer scan electrode 225 are respectively located on outsides of the inner sustain electrode 211 and the inner scan electrode 221.

The sustain electrodes and the scan electrodes are repeatedly and alternately disposed in each of the discharge cells 114*c*. That is, the sustain electrodes and the scan electrodes are formed in an order in which the sustain electrodes and the scan electrodes are formed in parallel with other in one of the discharge cells 214*a*, in another discharge cell 214*b* adjacent to a lower side of the discharge cell 214*a* in a vertical direction (in an extending direction of address electrodes 32) to the discharge cells 214*a*, a scan electrode and a sustain electrode are formed in parallel to each other, and, in another discharge cell (not shown) located below the discharge cell 214*b*, a sustain electrode and a scan electrode are formed parallel to each other.

The outer sustain electrode 215 is a closed loop shaped electrode, and an upper electrode and a lower electrode of the outer sustain electrode 215 are respectively disposed in two adjacent discharge cells 214*a* and 214*b* extending in a vertical direction. Accordingly, a sustain electrode 215*b* and the inner sustain electrode 211 in one discharge cell 214*a* are split electrodes. The outer scan electrode 225 is also a closed loop shaped electrode, and an upper electrode and a lower electrode of the outer scan electrode 225 are respectively disposed in two adjacent discharge cells 214*a* and 214*b* extending in a vertical direction. Accordingly, the scan electrodes 221 and 225 in one discharge cell 214*a* are split electrodes. However, the inner scan electrode 221 and the inner sustain electrode 211 are not loop shaped electrodes.

The inner sustain electrodes 211 in the two adjacent discharge cells 214*a* and 214*b* arranged in an extending direction of barrier ribs 33 (in an extending direction of address electrodes 32) are electrically connected by an inner sustain connection electrode 212. An outer sustain terminal electrode 217 is connected to an outer sustain connection electrode 216, and an inner sustain terminal electrode 213 is connected to the inner sustain connection electrode 212. Thus, the outer sustain terminal electrode 217 and the inner sustain terminal electrode 213 are disposed in a left side of the PDP, and are electrically connected to each of a plurality of signal transmission elements (not shown). Also, an inner scan terminal electrode 223 and an outer scan terminal electrode 227 are disposed in a right side of the PDP, and are electrically connected to each of a plurality of signal transmission elements (not shown).

To drive the PDP according to the present embodiment, the voltage waveforms described above with reference to FIGS. 5 and 6 are applied. Neon discharge can occur in a discharge cell 214*c* corresponding to a non-discharge space outside the PDP between the inner sustain connection electrode 212 and the outer scan electrode 225. To prevent neon discharge, a dummy barrier rib 234 is formed in a location between the inner sustain connection electrode 212 of a rear substrate 30 and the outer scan electrode 225. Due to the formation of the dummy barrier rib 234, the generation of neon discharge between the inner sustain connection electrode 212 and the outer scan electrode 225 can be prevented, and thus, the generation of orange visible light from the non-discharge cell 214*c* around a display region can be prevented.

Figure 8:
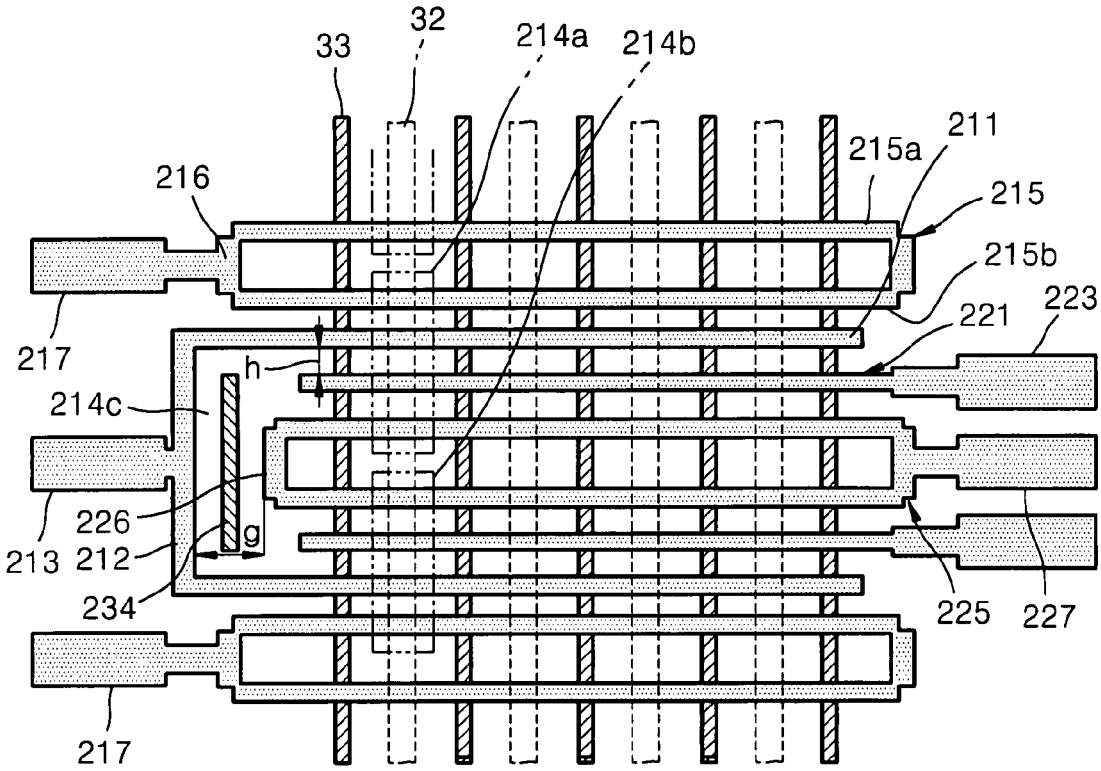
FIG. 8 is a plan view illustrating a modified version of the PDP of FIG. 7, according to an embodiment.

FIG. 8 is a plan view illustrating a modified version of the PDP of FIG. 7, according to an embodiment. Also, as depicted in FIG. 8, neon discharge can be prevented since a distance g between an inner sustain connection electrode 212 and an outer scan connection electrode 226, and between the inner sustain connection electrode 212 and an inner scan connection electrode 222 is greater than a distance h between an inner sustain electrode 211 and an inner scan electrode 221. Accordingly, the degradation of image quality of the PDP according to the current embodiment can be prevented.

Figure 9:
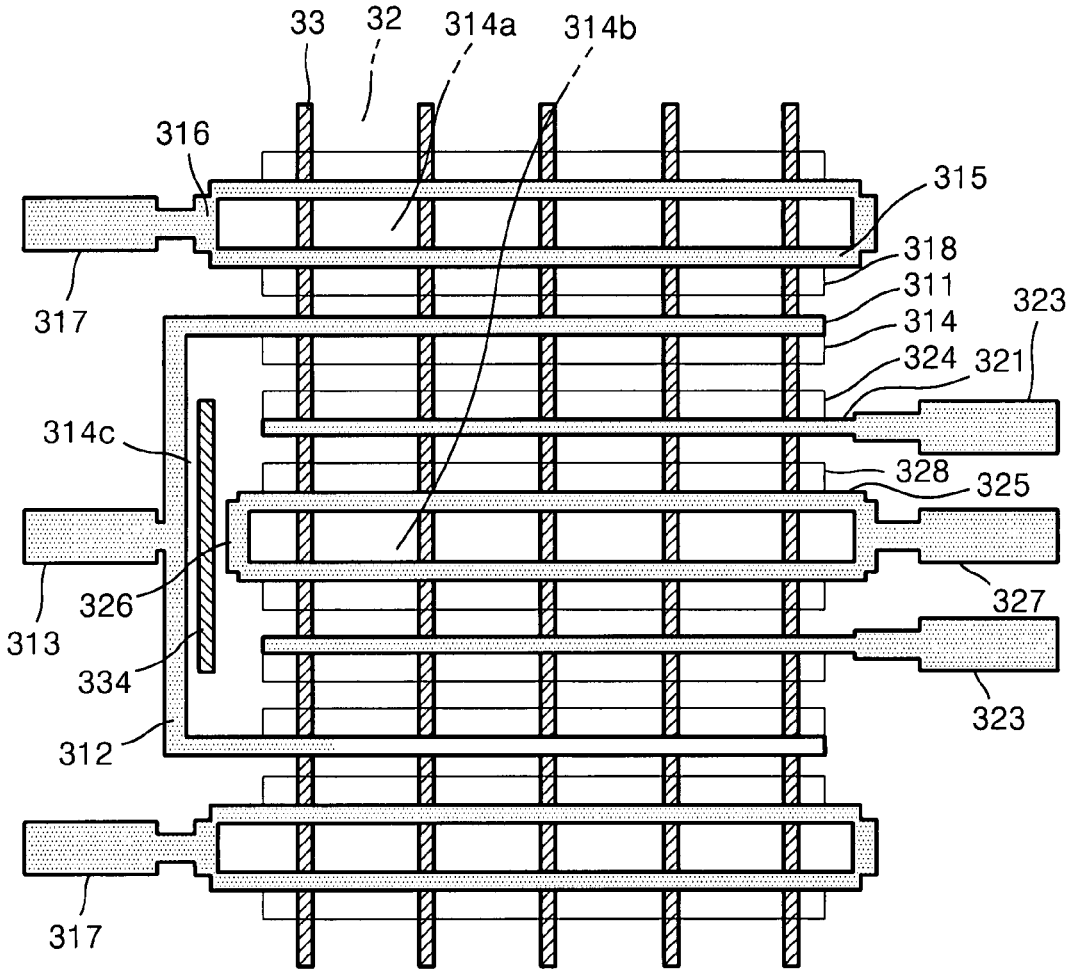
FIG. 9 a plan view illustrating a plasma display panel according to another embodiment.

FIG. 9 a plan view illustrating a PDP according to another embodiment. Here, the differences between the present embodiment and the previous embodiments will be mainly described.

Sustain electrodes and scan electrodes are formed in parallel to each other in discharge spaces of each of discharge cells 314*a* and 314*b*. Each of the sustain electrodes includes an outer sustain electrode 315 and an inner sustain electrode 311, and each of the scan electrodes includes an inner scan electrode 321 and an outer scan electrode 325. The inner sustain electrode 311 and the inner scan electrode 321 are formed in parallel to each other on both sides of the center of a discharge space of each of the discharge cells 314*a* and 314*b*, and the outer sustain electrode 315 and the outer scan electrode 325 are respectively formed on outer sides of the inner sustain electrode 311 and the inner scan electrode 321.

The sustain electrodes and the scan electrodes are repeatedly and alternately formed in each of the discharge cells 314*a* and 314*b*. That is, the sustain electrodes and the scan electrodes are formed in an order in which the sustain electrodes and the scan electrodes are formed in parallel to each other in one of the discharge cells 314*a*, in another discharge cell 314*b* adjacent to the discharge cells 314*a* in a vertical direction (in an extending direction of address electrodes 32) to the discharge cells 314*a*, a scan electrode and a sustain electrode are formed parallel to each other, and, in another discharge cell (not shown) located below the discharge cell 314*b*, a sustain electrode and a scan electrode are formed parallel to each other.

The outer sustain electrode 315 is a closed loop shaped electrode, and an upper electrode and a lower electrode of the outer sustain electrode 315 are respectively disposed in two adjacent discharge cells 314*a* and 314*b* extending in a vertical direction. Accordingly, the outer sustain electrode 315 and the inner sustain electrode 311 in one discharge cell 314*a* are split electrodes. The outer scan electrode 325 is also a closed loop shaped electrode, and an upper electrode and a lower electrode of the outer scan electrode 325 are respectively disposed in two adjacent discharge cells 314*a* and 314*b* extending in a vertical direction. Accordingly, the outer scan electrode 325 in one discharge cell 314*a* is a split electrode. However, the inner scan electrode 321 and the inner sustain electrode 311 are not loop shaped electrodes.

Transparent electrodes 318, 314, 328, and 324 are further formed on each of the outer sustain electrode 315, the inner sustain electrode 311, the outer scan electrode 325, and the inner scan electrode 321. That is, the outer sustain electrode 315, the inner sustain electrode 311, the outer scan electrode 325, and the inner scan electrode 321 are opaque metal electrodes, and overlap the transparent electrodes 318, 314, 328, and 324 which have a width greater than that of the opaque metal electrodes 315, 311, 325, and 321. Due to the formation of the transparent electrodes 318, 314, 328, and 324, the widths of the opaque metal electrodes 315, 311, 325, and 321 can be reduced. As a result, the opening rate of the discharge cells 314*a* and 314*b* can be increased and a discharge gap can be reduced, thereby readily generating discharge.

The inner sustain electrodes 311 in the two adjacent discharge cells 314*a* and 314*b* arranged in an extending direction of barrier ribs 33 (in an extending direction of the address electrodes 32) are electrically connected to each other by an inner sustain connection electrode 312. An outer sustain terminal electrode 317 is connected to an outer sustain connection electrode 316, an inner sustain terminal electrode 313 is connected to an inner sustain connection electrode 312, and the outer sustain terminal electrode 317 and the inner sustain terminal electrode 313 are disposed on a left side of the PDP and are respectively electrically connected to a plurality of signal transmission elements. Also, an inner scan terminal electrode 323 and an outer scan terminal electrode 327 are disposed on a right side of the PDP and are respectively electrically connected to a plurality of signal transmission elements.

In order to drive the PDP according to the present embodiment, the waveforms described with reference to FIGS. 5 and 6 can be applied. Neon discharge can occur in a non-discharge cell 314*c* corresponding to a space between the inner sustain connection electrode 312 and the outer scan electrode 325 in a non-discharge region outside a discharge region. To prevent neon discharge, a dummy barrier rib 334 is formed in a location between the inner sustain connection electrode 312 and the outer scan electrode 325. Due to the formation of the dummy barrier rib 334, the generation of neon discharge between the inner sustain connection electrode 312 and the outer scan electrode 325 can be prevented, and thus, the generation of orange visible light from the non-discharge cell 314*c* around a display region can be prevented.

Figure 10:
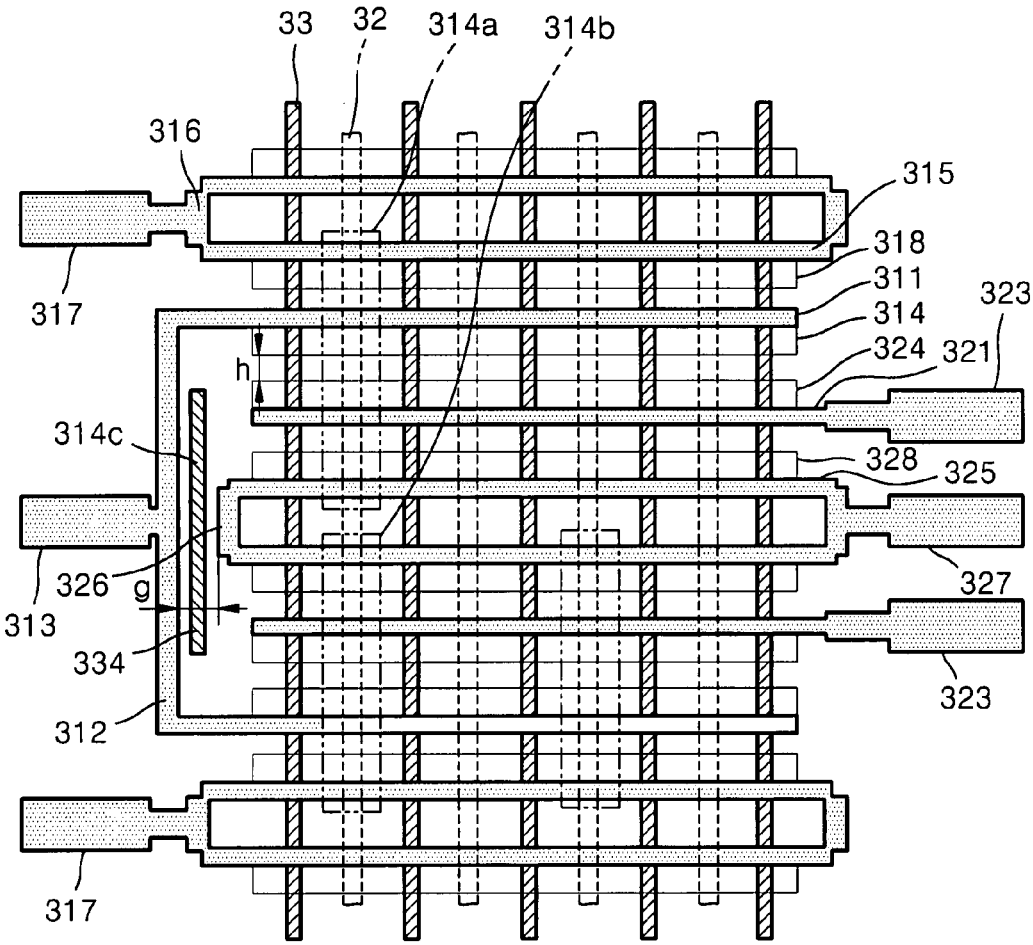
FIG. 10 is a plan view illustrating a modified version of the PDP of FIG. 9, according to an embodiment.

FIG. 10 is a plan view illustrating a modified version of the PDP of FIG. 9, according to an embodiment. Referring to FIG. 10, neon discharge can be prevented since a distance g between the inner sustain connection electrode 312 and the outer scan connection electrode 326 and between the inner sustain connection electrode 312 and the inner scan connection electrode 322 is greater than a distance h between the inner sustain electrode 311 and the inner scan electrode 321. Therefore, the degradation of image quality of the PDP according to the current embodiment can be prevented.

While the present embodiments have been particularly shown and described with reference to exemplary embodiments thereof, it will be understood by those of ordinary skill in the art that various changes in form and details may be made therein without departing from the spirit and scope of the present embodiments as defined by the following claims.

What is claimed is:

1. A plasma display panel comprising:

a first substrate;

a second substrate which is separated from the first substrate and faces the first substrate;

a plurality of barrier ribs formed between the first and second substrates and defining a plurality of discharge cells;

a plurality of sustain electrodes formed between the first and second substrates, comprising inner sustain electrodes and outer sustain electrodes;

a plurality of scan electrodes formed in parallel to the sustain electrodes and comprising inner scan electrodes and outer scan electrodes;

a plurality of address electrodes formed between the first and second substrates and extending in a direction crossing the sustain electrodes and the scan electrodes;

an inner sustain connection electrode that electrically connects the inner sustain electrodes formed in adjacent discharge cells arranged in the extending direction of the address electrodes; and a discharge prevention element that prevents the generation of discharge in a non-discharge region around the inner sustain connection electrode, wherein the sustain electrodes and the scan electrodes are repeatedly and alternately disposed in each of the discharge cells, and wherein adjacent electrodes of the outer sustain and outer scan electrodes formed in two adjacent discharge cells arranged in an extending direction of the address electrodes are electrically connected to each other.

2. The plasma display panel of claim 1, wherein the discharge prevention element is a dummy barrier rib formed on the second substrate.

3. The plasma display panel of claim 2, wherein the dummy barrier rib is located between an end portion of one of the scan electrodes and the inner sustain connection electrode.

4. The plasma display panel of claim 1, wherein the shortest distance between the inner sustain connection electrode and an end portion of the outer scan electrode is greater than the shortest distance between the inner sustain electrode and the inner scan electrode in such a manner that prevents the generation of discharge around the inner sustain connection electrode.

5. The plasma display panel of claim 4, wherein the distance between the inner sustain connection electrode and the outer scan connection electrode is at least twice the distance between the inner sustain electrode and the inner scan electrode.

6. The plasma display panel of claim 1, wherein the outer sustain electrodes, the inner sustain electrodes, the outer scan electrodes, and the inner scan electrodes are closed loop shaped electrodes.

7. The plasma display panel of claim 6, further comprising a short bar that electrically connects the outer sustain electrodes disposed between the outer sustain electrodes, further comprising a short bar that electrically connects the inner sustain electrodes disposed between the inner sustain electrodes, further comprising a short bar that electrically connects the outer scan electrodes disposed between the outer scan electrodes, and further comprising a short bar that electrically connects the inner scan electrodes disposed between the inner scan electrodes.

8. The plasma display panel of claim 7, wherein the short bars are formed at locations corresponding to portions of the barrier ribs.

9. The plasma display panel of claim 1, wherein the outer sustain electrodes, the inner sustain electrodes, the outer scan electrodes, and the inner scan electrodes respectively, are open type split electrodes.

10. The plasma display panel of claim 9, further comprising transparent electrodes contacting the outer sustain electrodes, the inner sustain electrodes, the outer scan electrodes, and the inner scan electrodes.

11. The plasma display panel of claim 1, wherein each of a plurality of voltages applied to the inner sustain electrodes and the outer sustain electrodes is independently controlled, and each of a plurality of voltages applied to the inner scan electrodes and the outer scan electrodes is independently controlled.

12. The plasma display panel of claim 11, wherein each of the voltages applied to the inner sustain electrodes and the outer sustain electrodes during address discharge prevents the diffusion of the address discharge from the inner sustain electrodes towards the outer sustain electrodes, and wherein each of the voltages applied to the inner scan electrodes and the outer scan electrodes during the address discharge prevents the diffusion of the address discharge from the inner scan electrodes towards the outer scan electrodes.

13. The plasma display panel of claim 11, wherein each of the voltages applied to the inner sustain electrodes and The outer sustain electrodes during sustain discharge after the address discharge allows the diffusion of the sustain discharge from the inner sustain electrodes towards The outer sustain electrode, and wherein each of the voltages applied to the inner scan electrodes and The outer scan electrodes during sustain discharge after the address discharge allows the diffusion of the sustain discharge from the inner scan electrodes towards the outer scan electrodes.

* * * * *